United States Patent [19]

Nishioka

[11] 3,942,148

[45] Mar. 2, 1976

[54] DEVICE FOR SIMULTANEOUSLY CONTROLLING A PLURALITY OF VARIABLE RESISTORS

[75] Inventor: Matsuo Nishioka, Kadoma, Japan

[73] Assignee: Matsushita Electric Industrial Company, Limited, Japan

[22] Filed: May 29, 1974

[21] Appl. No.: 474,213

[52] U.S. Cl. ..... 338/128; 74/471 XY; 200/6 A; 323/80; 338/90

[51] Int. Cl.[2] ..... H01C 9/02

[58] Field of Search ..... 338/90, 128, 129, 130, 338/131, 132, 196; 74/471 XY; 200/6 A; 340/366 D; 403/383; 323/80, 94 R

[56] References Cited

UNITED STATES PATENTS

| | | | |
|---|---|---|---|
| 2,762,234 | 9/1956 | Dood | 74/471 XY |
| 2,934,731 | 4/1960 | Cotton | 338/128 |
| 3,372,359 | 3/1968 | Wilson | 338/128 |
| 3,394,611 | 7/1968 | Beurrier | 74/471 XY |
| 3,478,293 | 11/1969 | Hooten, Jr. | 338/128 |
| 3,550,466 | 12/1970 | Ham | 74/471 XY |
| 3,629,775 | 12/1971 | Kindred | 338/128 |
| 3,701,963 | 10/1972 | Kasasima | 338/128 |
| 3,760,320 | 9/1973 | Oka et al. | 338/128 |
| 3,766,547 | 10/1973 | Saito et al. | 340/366 D |
| 3,781,752 | 12/1973 | Oka et al. | 338/128 |

*Primary Examiner*—Volodymyr Y. Mayewsky
*Attorney, Agent, or Firm*—Robert E. Burns; Emmanuel J. Lobato; Bruce L. Adams

[57] ABSTRACT

A bearing having a spherical bearing surface is attached to an opening formed at the center of the top wall of a casing. The bearing rotatably receives a spherical body having a control shaft which extends through the center of the spherical body and is securely fixed thereto. A plurality of rotary discs is spaced from, and juxtaposed on, the bottom wall of the casing. Each of the juxtaposed pairs of the rotary discs is rotatably coupled to one end of an elongated slidable member having an elongated guide slot in such a manner that the elongated member is moved transversely to the longitudinal axis thereof. Circular resistive elements are arranged on the bottom wall of the casing in opposed relation to the rotary discs. Each of the rotary discs has on its lower surface a contactor in slidable electrical contact with the corresponding resistive element. The lower end of the control shaft slidably extends through the guide slots of the elongated members which cross each other, but do not interfere with each other. An upright side member may be provided at each end of the elongated member to produce the effect of inertia for smooth movement of the elongated members. As the control shaft is rotated or inclined in any direction, the point of contact on each of two or four resistive elements may be simultaneously controlled.

3 Claims, 3 Drawing Figures

DEVICE FOR SIMULTANEOUSLY CONTROLLING A PLURALITY OF VARIABLE RESISTORS

The present invention relates generally to variable resistors, and particularly to a device for simultaneously controlling a plurality of variable resistors for use with, such as, a 4-channel stereophonic phonograph.

Prior art pertinent to the present invention is disclosed in U.S. Pat. No. 3,760,320 issued to S. Oka and M. Nishioka. In this patent, a bearing having a spherical bearing surface is attached to an opening formed at the center of the top wall of a casing having side walls. The bearing rotatably receives a spherical body having a control shaft which extends through the center of the spherical body and is securely fixed thereto. Variable resistors of the conventional type are attached to the side walls of the casing in such a manner that their rotary shafts may extend into the casing. Each of the opposed pairs of the variable resistors are interconnected with a bow-shaped elastic connecting member having an axially elongated slot. The lower end of the control shaft is fitted into the axially elongated slots of the connecting members which intersect each other, but do not interfere with each other.

The principal object of the invention is to provide an improved device for simultaneous control of variable resistors which is compact and has a flat configuration.

Another object of the invention is to provide an improved device for simultaneously controlling the variable resistors wherein two intersecting elongated members are slidably supported on a plurality of rotary discs spaced from, and juxtaposed on the bottom wall of the casing in order to reduce the overall thickness of the device.

A further object of the invention is to provide an improved device for simultaneously controlling the variable resistors wherein each of the intersecting members has an upright side member of a predetermined weight at each end of thereof to provide the inertia-producing effect for smooth movement of the intersecting members.

Briefly described, the present device has a pair of intersecting elongated members each being slidably coupled to a pair of juxtaposed rotary discs spaced from the bottom wall of a casing. Each of the intersecting members slides transversely to the longitudinal axis thereof and longitudinally of the other elongated member. In opposed relation to the rotary discs, arcuate shaped resistive elements are arranged. Each of the rotary discs has a contactor to provide electrical, slidable contact with the corresponding resistive element. As the intersecting members slide in directions perpendicular to each other, the rotary discs are caused to rotate about their axes. A bearing having a spherical inner surface and made of a synthetic resin by molding or the like is attached to an opening formed at the center of the top wall of the casing. The bearing rotatably receives a spherical body having a control shaft which extends through the center of the spherical body and is securely fixed thereto. Each of the intersecting members has an elongated guide slot and the lower end of the control shaft slidably extends through the guide slots of the intersecting members. As the control shaft is rotated or inclined in any direction the intersecting members are caused to slide transversely to their axes and longitudinally to each other, thus causing the rotary discs to rotate to vary the position of the contactor along the arcuate path of the corresponding resistive element. The intersecting members may be provided at each end thereof with an upright member of a predetermined weight to provide inertia to the slidable movements thereof.

These and other features of the present invention will become apparent from the following description taken in conjunction with the accompanying drawings, in which.

Figure 1:
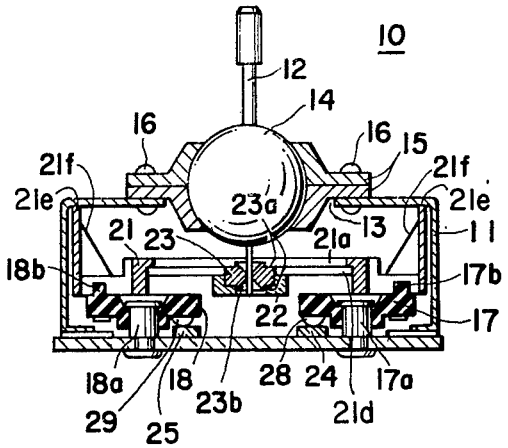
FIG. 1 is a cross-sectional view in elevation of a device for simultaneously controlling a plurality of variable resistors, taken along line I—I of FIG. 2.

Referring now to the drawings wherein like parts are numbered with like reference numerals. A uniaxial balance control device for simultaneously controlling a plurality of variable resistors is generally indicated at reference numeral 10 and comprises a casing 11 having an opening 13 at the center of the top wall thereof. A pair of electrically insulative bearings 15 with spherical inner bearing surface is attached to the opening 13 by means of the rivets 16. A bearing 15 rotatably receives a spherical body 14 having a control shaft 12 which extends through the center of the spherical body 14 and is securely fixed thereto. The control shaft 12 is thus pivotally movable with respect to the center of the spherical body 14. The lower end of the control shaft 12 extends into the interior of the casing 11 and has preferably a smaller diameter than that of the upper end thereof for the reason described hereinbelow. A plurality of electrically insulative rotary discs 17, 18, 19 and 20 are juxtaposed on the bottom wall of the casing with a spacing therefrom, with their rotary shafts **17*a*, 18*a*, 19*a* and 20*a* rotatably supported on the bottom wall. There is provided a pair of intersecting electrically insulative elongated members 21 and 22 each being preferably at right angles to the other. Each of the elongate members 21 and 22 has a pair of guide slots 21*b* and 21*c* (22*b* and 22*c*). The rotary discs or cams 17 to 20 have upright projections 17*b*, 18*b*, 19*b* and 20*b*, respectively on the upper surface thereof and adjacent to the periphery thereof, which are respectively received in the guide slots 21*b*, 21*c*, 22*b* and 22*c* of the elongated members or slides 21 and 22. The elongated members 21 and 22 are thus slidably movable transversely to the longitudinal axes thereof and longitudinally with respect to each other. Each of the elongated members 21 and 22 is further provided with an elongated guide slot 21*a* (22*a*) and a stepped shoulder portion 21*d* (22*d*) along the edges of the guide slots. An interlocking element 23 of circular configuration having annular inwardly cutaway portions 23*a* on the opposite sides thereof is slidably received in the guide slots 21*a* and 22*a* with the annular cutaway portions 23*a* engaging the stepped shoulder portions 21*d* and 22*d*. The interlocking element 23 is provided with an opening or bore 23*b* having increasing diameters towards the opposite sides thereof forming a neck portion at the intermediate position thereof. The lower end of the control shaft 12 extends slidably through the neck portion of the opening 23*b* of the interlocking element 23.**

On the electrically insulative bottom wall of the casing 11 there is disposed a plurality of resistive elements 24, 25, 26 and 27 of generally arcuate configuration, each being arranged in opposed relation to the rotary discs 17, 18, 19 and 20, respectively. The terminal ends 24*a* and 24*b* of the resistive element 24 are adapted for electrical connection to external circuitry, such as sound control circuitry associated with a corresponding sound channel (not shown). Similarly, the other resistive elements have their terminals connected to associated sound control circuits. The rotary discs 17 to 20 are provided on the lower surface thereof with contactors 28, 29, 30 and 31, respectively, such as brushes, so that electrical slidable contacts are maintained with the corresponding resistive elements. The contactor 28 of the rotary disc 17 is connected to a terminal 24*c* so that a resistance circuit is provided between the terminal 24*a* or 24*b* and the terminal 24*c*.

Figure 2:
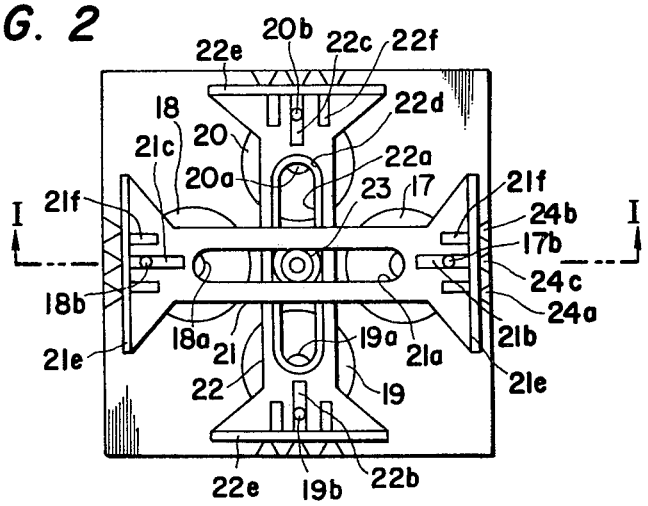
FIG. 2 is a plan view of the device of FIG. 1 with a casing removed.
Figure 3:
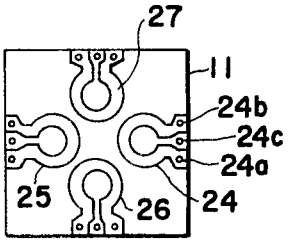
FIG. 3 is a plan view illustrating the arrangement of a plurality of resistive elements on the bottom wall of the casing.

Each of the elongated members 21 and 22 has the opposite ends thereof flared outwardly as illustrated in FIG. 2 and a pair of upright side members 21*e* (22*e*) of a predetermined weight is provided along the edges of the flared portions by support members 21*f* (22*f*). The upper edge of the side members 21*e* (22*e*) may preferably be in slidable contact with the top wall of the casing 11 as illustrated in FIG. 1.

In operation, as the operator pivotally moves the upper end of the control shaft 12 to rotate or incline the shaft in any direction, the interlocking element 23 slidably moves along the guide slots 21*a* and 22*a*. The pivotal movement of the control shaft 12 thus results in slidable two-dimensional movements of the elongated members 21 and 22 in directions perpendicular to each other. The adjacent inner edge of each of the guide slots 21*b*, 21*c* of elongated member 21, for instance, pushes the upright projection 17*b* causing the rotary disc 17 to rotate about its axis. Simultaneously, the remainder rotary discs are caused to rotate about their axes. This in turn causes the position of the contactors 28 to 31 to correspondingly vary with respect to a reference resistance point on the corresponding resistive elements 24 to 27. The increasing diameters of the aperture 23*b* of the interlocking element 23 allows the control shaft 12 to incline to a desired angle and the annular inwardly cutaway portions 23*a* allows the interlocking element 23 to exactly keep track of the guide slots 21*a* and 22*a*. It is however to be noted that the interlocking element 23 may be dispensed with if the lower end of the control shaft 12 has a sufficient diameter to be slidably fitted into the guide slots 21*a* and 22*a*. The provision of a pair of upright side members of a predetermined weight at the opposite ends of each of the elongated members 21 and 22 provides an inertia-producing effect so that smooth movements of the elongated members are assured. The upright side members, being in slidable contact with the top wall of the casing, ensure that the elongated members 21 and 22 slide exactly on a two-dimensional plane.

Furthermore, it is seen that the rotary discs 17 to 20 in combination with the corresponding resistive elements 24 to 27 serve as slidable supporting elements for the elongated members 21 and 22 as well as variable resistors. Conventional variable resistors may be employed by connecting their rotary shafts to the rotary shafts 17*a* to 20*a* of the rotary discs. However, the present invention achieves compact, flat configuration which is particularly useful for applications where space is limited. The intersecting elongated members 21 and 22 so arranged as described in the foregoing description also have influence in attaining the flat configuration.

The foregoing description shows only a preferred embodiment of the present invention. Various modifications are apparent to those skilled in the art without departing from the scope of the present invention which is only limited by the appended claims. Therefore, the embodiment shown and described is only illustrative, not restrictive.

What is claimed is:

1. A device for simultaneously controlling the settings of a plurality of variable resistors, comprising:

a case having a top wall with an aperture therethrough; an electrically insulative bottom wall, and a pair of opposed side walls;

a control shaft pivotally mounted on said top wall and extending through said aperture into said case;

means pivotally mounting said control shaft on said top wall;

a first and a second elongated slide each having an elongated guide slot extending longitudinally thereof, said slides disposed within said case and disposed perpendicular to each other;

an interlocking member having an axial bore and disposed extending through the respective guide slots of said slides with said control shaft extending into said bore, said interlocking member being dimensioned to slidably fit within said guide slots to permit said interlocking member to move longitudinally of said slides within said guide slots, said axial bore extending through said interlocking member and having a diameter dimensioned for receiving said control shaft and having a minimum diameter at an intermediate position within said bore and an increasing diameter in directions along said bore away from said intermediate position to permit movement of said interlocking member when said control shaft is pivoted thereby to displace said slides;

a first pair and a second pair of generally arcuate resistive elements each having a terminal for making electrical connection thereto, said first pair of resistive elements disposed on said bottom wall adjacent opposite ends of said first slide and said second pair of resistive elements disposed on said bottom wall adjacent opposite ends of said second slide; and four cams each disposed between an end of one of said slides and the one of said resistive elements adjacent the end of one of said slides, each of said cams being mounted for rotation on said bottom wall and having a contactor for making electrical contact with an adjacent one of said resistive elements upon rotation, and each cam having means engaging the end of the respective one of said slides adjacent thereto for effecting rotation of said cams upon movement of said slides thereby to move said contactors along said resistive elements.

2. A device as claimed in claim 1, wherein each of said first and second elongated slides is provided at the opposite ends thereof with means for producing inertia.

3. A device as claimed in claim 2, wherein said means for producing inertia is in slidable contact with said one of said opposed walls to develop resistance to the displacement of said slides.

* * * * *